US010480248B2

(12) United States Patent
Bulloch et al.

(10) Patent No.: US 10,480,248 B2
(45) Date of Patent: Nov. 19, 2019

(54) WHIPSTOCK VALVE WITH NOZZLE BYPASS FEATURE

(71) Applicant: Baker Hughes, a GE company, LLC, Houston, TX (US)

(72) Inventors: Dylan A. Bulloch, Houston, TX (US); Gregory L. Hern, Porter, TX (US); Larry T. Palmer, Spring, TX (US); Jason L. Cullum, League City, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 16 days.

(21) Appl. No.: 15/916,047

(22) Filed: Mar. 8, 2018

(65) Prior Publication Data

US 2018/0195346 A1 Jul. 12, 2018

Related U.S. Application Data

(62) Division of application No. 14/824,921, filed on Aug. 12, 2015, now Pat. No. 9,926,745.

(51) Int. Cl.
*E21B 34/10* (2006.01)
*E21B 7/06* (2006.01)
(Continued)

(52) U.S. Cl.
CPC ..... *E21B 7/061* (2013.01); *E21B 29/06* (2013.01); *E21B 34/10* (2013.01); *E21B 2034/007* (2013.01)

(58) Field of Classification Search
CPC ..... E21B 21/103; E21B 34/103
See application file for complete search history.

(56) References Cited

U.S. PATENT DOCUMENTS 4,072,166 A * 2/1978 Tiraspolsky ..... E21B 21/103 137/496
4,162,691 A 7/1979 Perkins
(Continued)

FOREIGN PATENT DOCUMENTS

GB 2345934 A 7/2000

OTHER PUBLICATIONS

Tiraspolsky et al., Valve apparatus for deep drilling, 1978, text only version of U.S. Pat. No. 4,072,166 (Year: 1978).*
(Continued)

*Primary Examiner* — D. Andrews
(74) *Attorney, Agent, or Firm* — Shawn Hunter

(57) ABSTRACT

A valve for subterranean whipstock service has a side port and a through passage with a biased movable sleeve to shift between circulation mode into the annulus and flow through mode for setting an anchor and then feeding window mill nozzles. The valve is run in when in circulation mode to allow operation of a measurement while drilling device. When the whipstock is properly oriented the pressure is increased to break a shear pin to allow a spring to bias the sleeve to the flow through position. The shifting of the sleeve opens a bypass passage around the restriction orifice that was first used to build pressure to break the shear pins that let the sleeve move under spring bias. As a result the spring can hold the sleeve in position despite high flow rates needed to remove cuttings from the mill as the window is opened.

10 Claims, 2 Drawing Sheets

(51) Int. Cl.
*E21B 29/06* (2006.01)
*E21B 34/00* (2006.01)

(56) References Cited

U.S. PATENT DOCUMENTS

| | | | | |
|---|---|---|---|---|
| 5,443,129 | A | 8/1995 | Bailey et al. | |
| 5,873,414 | A | 2/1999 | Von | |
| 6,293,342 | B1 | 9/2001 | McGarian et al. | |
| 6,675,897 | B1 | 1/2004 | McGarian et al. | |
| 2007/0181313 | A1 | 8/2007 | Churchill et al. | |
| 2009/0255592 | A1* | 10/2009 | Caccialupi | E21B 21/103 137/498 |
| 2009/0266544 | A1 | 10/2009 | Redlinger et al. | |
| 2013/0341048 | A1 | 12/2013 | Delgado et al. | |
| 2015/0361764 | A1 | 12/2015 | Cronley et al. | |

OTHER PUBLICATIONS

Smith Drilling & Evaluation, Trackmaster Plus Equipment, Whipstock Product Data Sheet, Sep. 2008, 2 pages.

* cited by examiner

WHIPSTOCK VALVE WITH NOZZLE BYPASS FEATURE

CROSS REFERENCE TO RELATED APPLICATION

This application is a Divisional Application of U.S. application Ser. No. 14/824,921 filed on Aug. 12, 2015, which is incorporated by reference herein in their entirety.

FIELD OF THE INVENTION

The field of the invention is diverter valves for subterranean use and more particularly valves that use a restrictor to allow shifting between modes of circulation and flow through.

BACKGROUND OF THE INVENTION

When milling to create a lateral exit from a tubular string a typical bottom hole assembly will have a measurement while drilling (MWD) sub for guidance of the bottom hole assembly. This device requires flow through it to operate. Additionally an anchor is located below a whipstock above which a milling assembly is located for milling laterally through a tubular wall for an exit for a lateral. The anchor requires a pressure buildup to set. The MWD device assists with orientation of the whipstock ramp in the desired direction before the anchor is set. Typically a ported sub has been used to allow circulation for the operation of the MWD until the desired depth and whipstock orientation is obtained. At that point pressure through a restrictor is built up to break a shear pin holding a movable sleeve. A biasing spring then shifts the sleeve to close the lateral ports in the ported sub with the surface pumping equipment preferably in the off position after the shear pin is severed. Thereafter the pressure is again applied to set the whipstock anchor. After the whipstock anchor is set the pressure is built up to break a rupture disc on the assembly of mills so that flow can go through mill nozzles as the mills are advanced down the whipstock ramp to make the lateral exit or window. Setting the anchor requires no flow but the subsequent operation of flowing through the mills does require flow. The flow in the past design had to go through the restriction orifice used to shift the sleeve from the circulation to the flow through position. This meant that the flow for the milling operation would try to move the sleeve back to the circulation position against the force of the spring that pushed the sleeve in the first place from the circulation to the flow through position. As a result the prior design employed a snap ring to prevent return movement of the sleeve against the force of the bias from the spring. The use of the snap ring to retain the sleeve position proved problematic from several respects. The design was expensive to build and assembly and the snap ring at times hung up and failed to hold the shifted sleeve in position. Another operational problem was the need for the high circulation rates when milling to remove cuttings also mean high pressure drops as the high flow rates required would still have to go through a restriction. The restriction upstream of the mill nozzles also took away a signal to surface personnel as to the flow conditions at the mill nozzles. Finally the use of high flow rates through the restriction created issues of erosion at the restriction and at other locations that saw high velocities. While one design offered by Baker Hughes Incorporated of Houston Tex. accomplished sleeve shifting with pressure buildup that broke a shear pin a competing design used a restriction in conjunction with a j-slot mechanism to reposition a sleeve in the ported sub from a circulation position to a flow through orientation after a predetermined number of cycles of applied and removed pressure. This design also had flow continuing to go through the restriction that enabled the j-slot mechanism after the sleeve was shifted from the circulation to the flow through positions.

FIGS. 1-3 illustrate the basics of the Baker Hughes Incorporated Whipstock Valve described above. A spring 21 pushed on a sleeve 18 when applied pressure broke shear pin 17. In the FIG. 2 position, flow from passage 30 is directed to lateral port 32 for circulation to let the MWD operate. Seals 13 and 15 close off passage 30 to straight through flow. A snap ring 9 moves left past sleeve 8 so that reverse movement of seals 16 cannot happen. Comparing FIGS. 2 and 3 it can be seen that when seal 16 crosses ports 32 it closes off those ports. Coincidentally, movement of sleeve 18 opens passage 30 to allow straight through pressure application to set an anchor for the whipstock and subsequent flow after breaking a rupture disc that previously isolated the mills to allow setting the anchor, to feed the mill nozzles for debris removal as the window is milled. In both FIGS. 2 and 3 the flow goes through the carbide nozzle 7. As can be seen with flow going straight through the valve assembly the flow through the nozzle 7 tries to push the sleeve 18 against the spring 21 so that the snap ring 9 is needed to resist that force. Again the shortcomings of this design were discussed in detail above. The competing design using the j-slot to shift the sleeve position still had similar issues.

The present invention is a redesign of the valve of FIGS. 1-3 with the principal difference being that the restriction is bypassed when the sleeve is shifted by the spring to the flow through position. While there is still some flow through the orifice, the bulk of the flow goes through the bypass so that the biasing spring can hold the sleeve in position for flow through the ported sub even when high flow rates for milling the window are developed. These and other aspects of the present invention will be more readily apparent from a review of the detailed description of the preferred embodiment and the associated drawings while recognizing that the full scope of the invention is to be determined by the appended claims.

SUMMARY OF THE INVENTION

A valve for subterranean whipstock service has a side port and a through passage with a biased movable sleeve to shift between circulation mode into the annulus and flow through mode for setting an anchor and then feeding window mill nozzles. The valve is run in when in circulation mode to allow operation of a measurement while drilling device. When the whipstock is properly oriented the pressure is increased to break a shear pin to allow a spring to bias the sleeve to the flow through position. The shifting of the sleeve opens a bypass passage around the restriction orifice that was first used to build pressure to break the shear pins that let the sleeve move under spring bias. As a result the spring can hold the sleeve in position despite high flow rates needed to remove cuttings from the mill as the window is opened.

DETAILED DESCRIPTION OF THE PREFERRED EMBODIMENT

Figure 4:
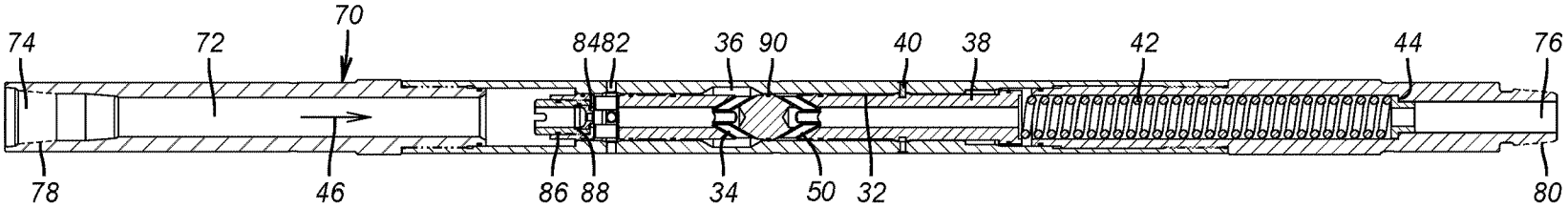
FIG. 4 is a section view of the valve of the present invention showing it in the circulation mode.
Figure 5:
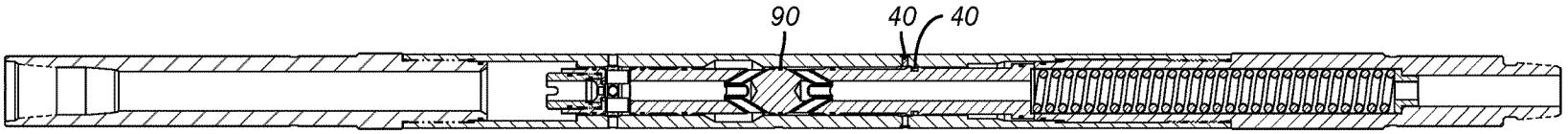
FIG. 5 is the view of FIG. 4 showing the shear pin sheared with pressure still applied.

Referring to FIG. 4 a housing 70 has a through passage 72 having an upper end 74 and a lower end 76. Threads 78 and 80 connect the housing 70 to a tubular string that is not shown. In the preferred embodiment a measurement while drilling module would be connected above the housing 70 and a window milling assembly, whipstock and anchor would be connected below to thread 80. A plurality of circumferentially spaced lateral ports 82 are in communication with passage 72 in FIG. 4 through a restriction orifice 84. Seals 86 and 88 prevent fluid entering at the top end 74 of the passage 72 from bypassing the orifice 84. Seal 90 is against inner wall 32 of passage 72 preventing any flow into slanted passages 50. Recess 36 allows bypassing of seal 90 when sleeve 38 is made to shift. Initially sleeve 38 is shear pinned by pins 40. A spring 42 pushes against sleeve 38 when the sleeve 38 is in the FIG. 4 position and restrained by pins 40. Spring 42 is supported by shoulder 44 on housing 70.

Arrow 46 represents initial circulation flow that exits ports 82 to establish circulation for the operation of the measurement while drilling device. This is done to properly orient the whipstock that is not shown before the anchor below it can be set with built up pressure. Once the proper whipstock depth and orientation are established, the circulation rate is increased through the orifice 84 which causes the force on sleeve 38 to be increased. At some point the higher force on the sleeve 38 results in the shear pins 40 shearing but with the flow being maintained the seal 90 is still against inner wall 32 and the ports 82 are still open. This means that the passage 72 is still closed to its lower end 76 and still open to lateral ports 82.

Figure 1:
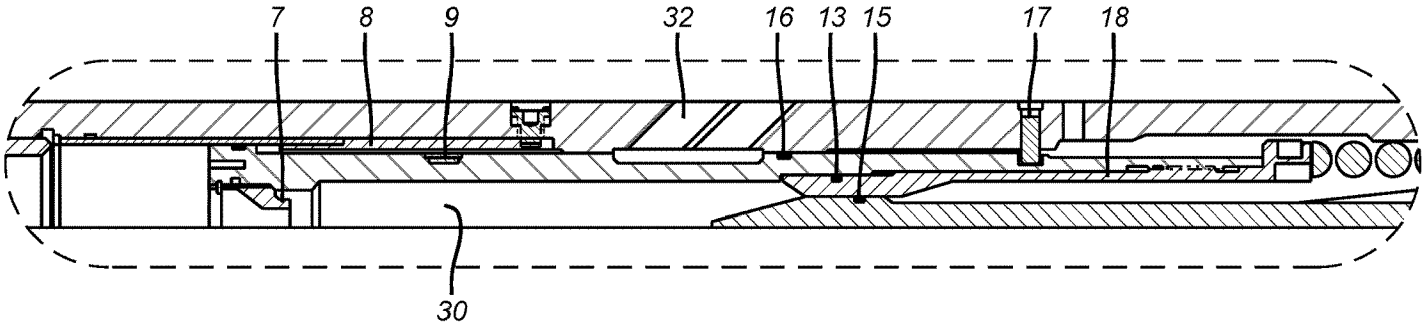
(PRIOR ART) FIG. 1
FIG. 1 is an enlarged section view of the prior art valve in the circulating position.
Figure 2:
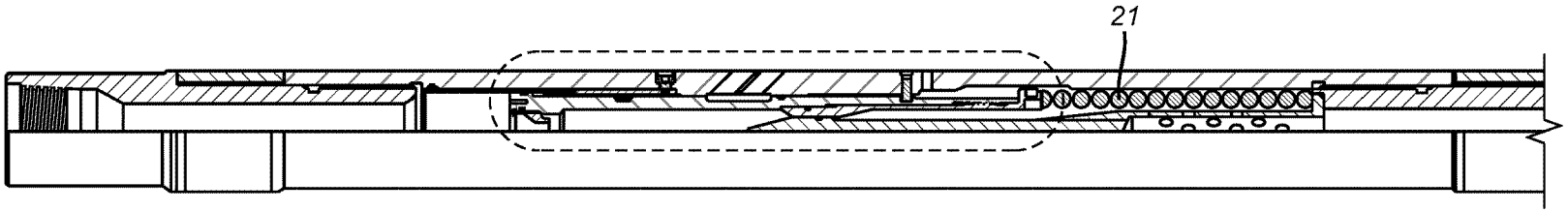
(PRIOR ART) FIG. 2
FIG. 2 is the view of FIG. 1 showing the entire valve on both sides of what is shown in FIG. 1.
Figure 3:
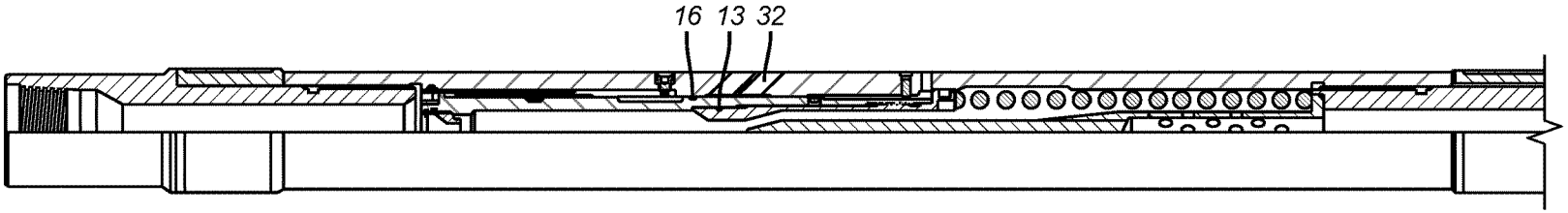
(PRIOR ART) FIG. 3
FIG. 3 is the view of FIG. 2 after the valve is shifted to a flow through position.
Figure 6:
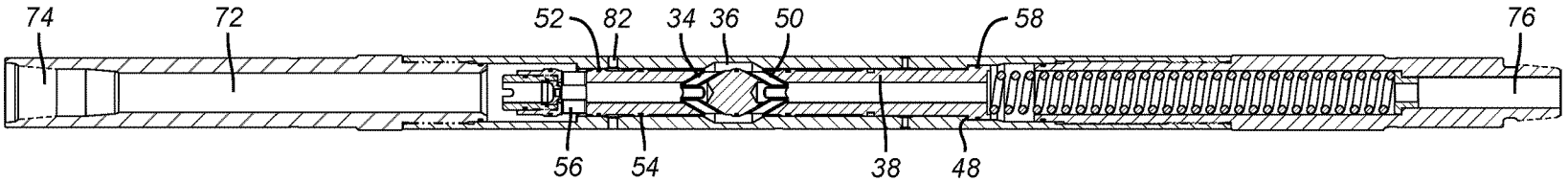
FIG. 6 shows the shifted position of the sleeve when the pressure is turned off and the valve in the flow through position with the restriction orifice bypassed.

When the pumps are turned off at the well surface, as shown in FIG. 6 the spring 42 is able to push sleeve 38 toward the upper end 74 of the passage 72 so that seal 90 moves off surface 32 and due to the positioning of recess 36 allows passages 34 communicate with passages 50 so that flow is directed through the passage 72 from end 74 to end 76. At the same time the movement of sleeve 38 positions seals 52 and 58 on opposed sides of ports 82 to close them off. However, ports 56 in sleeve 38 have now shifted enough toward upper end 74 of the passage 72 such that flow into passage 72 now can travel around the orifice 84 and through ports 56 and into passages 34 followed by recess 36 and then to passages 50 and through the spring 42 to lower end 76 of the passage 72. Sleeve 38 has been pushed until it shoulders on radial surface 48 and the force of the spring 42 is sufficient to hold the sleeve 38 in the FIG. 6 position. The reason is that very little flow will pass through the orifice 84 in the FIG. 6 position as the open area of ports 56 is more than 6 times the area of the orifice 84. While flow through the orifice 84 will put some downhole oriented force on the sleeve 38 the spring force from spring 42 can readily overcome that force so that locking sleeve 38 in its shifted position will no longer be needed as in the prior design shown in FIGS. 1-3.

Those skilled in the art will appreciate that the new design with the bypassing of the orifice due to the shifting of ports 56 from alignment with ports 82 for running in to an open position in to passage 72 near its top end 74 with ports 82 closed off and the lower end 76 of passage 72 opened up allows the spring itself to fixate the sleeve 38 without snap rings or other fasteners. The design becomes more reliable and cheaper to manufacture as well. When milling the pressure buildup seen at the surface is fully reflective of the flow at the milling nozzles because the orifice 84 is essentially bypassed even though some minimal flow may go through it. This makes the milling operation more reliable as there is direct data at the surface as to the condition of the milling nozzles and the pressure drop through them. Erosion damage to the orifice 84 is also minimized. While a coil spring is shown other springs such as a stack of Belleville washers or a piston under gas pressure can be used to bias the sleeve 38.

The above description is illustrative of the preferred embodiment and many modifications may be made by those skilled in the art without departing from the invention whose scope is to be determined from the literal and equivalent scope of the claims below:

We claim:

1. A valve for subterranean use, comprising:

a housing having a passage therethrough and a lateral port;

a sleeve selectively moveable to align a sleeve port in said sleeve to said lateral port in a circulation configuration and to align said sleeve port to the lower end of said passage in a flow through configuration;

said sleeve comprising a restriction orifice responsive to flow therethrough to shift said sleeve between said circulation and flow through configurations whereupon a flow bypass around said restriction orifice is open in said flow through configuration;

said sleeve is releasably secured in said circulation configuration until a predetermined pressure is achieved at said orifice; and said sleeve is biased toward said flow through configuration when released from being releasably secured.

2. The valve of claim 1, wherein:

said sleeve seals off said lower end of said passage in said circulation configuration.

3. The valve of claim 1, wherein:

said sleeve comprises a passage leading to the sleeve port that aligns with said lateral port in said circulation configuration.

4. The valve of claim 3, wherein:

said sleeve port is sealingly isolated from said lateral port in said flow through configuration.

5. The valve of claim 4, wherein:

said sleeve port serves as said flow bypass for said orifice in said flow through configuration.

6. The valve of claim 5, wherein:

said sleeve opens said passage lower end in said flow through configuration.

7. The valve of claim 6, wherein:

said sleeve comprises a passage therethrough that is blocked and having spaced slanted passages around a seal engaging a wall of said passage to prevent flow between said bypass passages in said circulation configuration.

8. The valve of claim 7, wherein:

said seal moving to a recessed location on said passage to allow flow between said spaced slanted passages in said flow through configuration.

9. The valve of claim 1, wherein:

said bias comprises at least one spring or compressed gas.

10. The valve of claim 9, wherein:

said sleeve is held in said flow through configuration exclusively by said bias.

* * * * *